US009809936B2

(12) United States Patent
Van Reijen et al.

(10) Patent No.: US 9,809,936 B2
(45) Date of Patent: Nov. 7, 2017

(54) SUBSTRUCTURE FOR AN ARTIFICIAL LAWN

(75) Inventors: Peter Van Reijen, Uden (NL); Ronald Koning, Zandvoort (NL)

(73) Assignee: DESSO SPORTS SYSTEMS N.V., Dendermonde (BE)

( * ) Notice: Subject to any disclaimer, the term of this patent is extended or adjusted under 35 U.S.C. 154(b) by 0 days.

(21) Appl. No.: 14/232,543

(22) PCT Filed: Jul. 9, 2012

(86) PCT No.: PCT/NL2012/050490

§ 371 (c)(1),
(2), (4) Date: Jul. 9, 2014

(87) PCT Pub. No.: WO2013/009174

PCT Pub. Date: Jan. 17, 2013

(65) Prior Publication Data

US 2014/0341651 A1 Nov. 20, 2014

(30) Foreign Application Priority Data

Jul. 13, 2011 (NL) ..... 2007101
Feb. 14, 2012 (NL) ..... 2008291

(51) Int. Cl.
*E01C 13/08* (2006.01)
*E01C 13/02* (2006.01)

(52) U.S. Cl.
CPC ..... *E01C 13/083* (2013.01); *E01C 13/02* (2013.01); *E01C 13/08* (2013.01)

(58) Field of Classification Search
CPC ..... E01C 13/02; E01C 13/08; E01C 13/083
See application file for complete search history.

(56) References Cited

U.S. PATENT DOCUMENTS 4,044,179 A * 8/1977 Haas, Jr. ..... 428/17
4,878,780 A 11/1989 Vidal
5,006,013 A 4/1991 Burkstaller
5,752,784 A * 5/1998 Motz et al. ..... 405/37
5,958,527 A * 9/1999 Prevost ..... 428/17
(Continued)

FOREIGN PATENT DOCUMENTS

EP 0204381 12/1986
EP 1462572 9/2004
(Continued)

OTHER PUBLICATIONS

National Small Flows; Pipeline; 1999; Schematic of a Wisconsin Mound System.*

(Continued)

*Primary Examiner* — Benjamin Fiorello
(74) *Attorney, Agent, or Firm* — Casimir Jones, SC

(57) ABSTRACT

A substructure (1) for an artificial lawn, comprising a top layer (4) of artificial grass fibers (5) and a substratum (2), which substratum comprises a number of individual layers, including a base layer (2), an intermediate layer (7) positioned on top of said base layer an a sand layer (3) positioned on top of said intermediate layer, wherein said sand layer comprises at least two sublayers, wherein the first sublayer (11) comprises a sand fraction having a particle size which is larger than the particle size of the sand fraction of the second sublayer (13).

17 Claims, 2 Drawing Sheets

(56) References Cited

U.S. PATENT DOCUMENTS

| | | | | |
|---|---|---|---|---|
| 5,976,645 | A * | 11/1999 | Daluise et al. | 428/17 |
| 8,740,141 | B2 * | 6/2014 | Prevost et al. | 244/110 E |

FOREIGN PATENT DOCUMENTS

| | | | | |
|---|---|---|---|---|
| EP | 2039831 | | 3/2009 | |
| IE | GB 2245132 | A * | 1/1992 | E01C 13/083 |
| WO | 99/66783 | | 12/1999 | |
| WO | 01/37657 | | 5/2001 | |

OTHER PUBLICATIONS

International Preliminary Report on Patentability dated Jan. 23, 2014 from PCT/NL2012/050490.

* cited by examiner

SUBSTRUCTURE FOR AN ARTIFICIAL LAWN

CROSS-REFERENCE TO RELATED APPLICATIONS

This application is a U.S. 371 national phase entry of pending International Patent Application No. PCT/NL2012/050490, international filing date Jul. 9, 2012, which claims priority to Dutch Patent Application No. NL2007101, filed Jul. 13, 2011 and Dutch Patent Application No. NL2008291, filed Feb. 14, 2012, the contents of which are incorporated by reference in their entireties.

FIELD OF THE INVENTION

A substructure for an artificial lawn, comprising a top layer of artificial grass fibres and a substratum, which substratum comprises a number of individual layers, including a base layer, an intermediate layer positioned on top of said base layer and a sand layer positioned on top of said intermediate layer, wherein said sand layer comprises at least two sublayers, wherein the first sublayer comprises a sand fraction having a particle size which is larger than the particle size of the sand fraction of the second sublayer.

BACKGROUND

A substructure for an artificial lawn, comprising a top layer of artificial grass fibres and a substratum, which substratum comprises a number of individual layers, including a base layer, an intermediate layer positioned on top of said base layer and a sand layer positioned on top of said intermediate layer, wherein said sand layer comprises at least two sublayers, wherein the first sublayer comprises a sand fraction having a particle size which is larger than the particle size of the sand fraction of the second sublayer.

The present invention relates to a substructure for an artificial lawn, comprising a top layer of artificial grass fibres and a substratum positioned under said top layer, which substratum comprises a number of individual layers, including a base layer, an intermediate layer positioned on top of said base layer and a sand layer positioned on top of said intermediate layer.

Such a substructure is known per se from Dutch patent NL 1021171, in which an artificial lawn is made up of a relatively hard base layer, on which a flat layer of a resilient and/or damping material is arranged, which layer may have a thickness of about 6-35 mm, for example 10-14 mm. Arranged on top of said resilient and/or damping layer is a top layer in the form of a synthetic turf consisting of a backing layer and artificial grass stalks attached thereto by tufting, knitting or weaving. The resilient and/or damping layer may be formed in various ways, for example by starting from a mixture of rubber granules mixed with a liquid binder, for example polyurethane.

A substructure for playing golf is known per se from British patent publication GB 2 072 022.

International application WO 2006/007862 further discloses a base for a sports floor.

From Dutch patent No. 1013987 there is furthermore known a base provided on a foundation layer for a sports field that is at least partially covered with grass, which base partially consists of rock wool.

Dutch patent No. 1016193 discloses an artificial lawn comprising a drainage layer made up of pebbles, a base layer arranged on top of said drainage layer, which base layer comprises the originally dug-off and subsequently removed soil, and a top layer with fibres present therein.

From European application EP 1 428 935 there is known a substructure for an artificial lawn in which a so-called "undersheet" of a geotextile material is laid over a prepared base, on which undersheet a layer of sand is arranged, on which subsequently a layer of rubber and finally a textile web are laid so as to thus form a so-called "envelope". The undersheet and the textile web are bonded together at their margins. Finally, an artificial lawn is installed on said substructure.

European application EP 0 093 008 discloses a base on which an envelope of a particular fabric is arranged, which envelope is filled with sand, for example, a base layer comprising a sheet of bound rubber particles, on which base layer an artificial lawn or a polyethylene foam layer can be laid. Depending on the sport to be practised, different sand grain sizes are used.

European application EP 1 462 572 relates to a substructure for sports floors, comprising a sand package provided with a water distribution system, which system comprises distribution pipes connected to a water reservoir.

Artificial lawns are generally used for a large number of sports, for example soccer and field hockey. If an artificial lawn is used for playing field hockey, it is advisable to water the lawn before it is used. Generally, use is made of a sprinkler installation in such a situation, by means of which a layer of water is applied to the lawn in a short time via a number of sprinkler points. In practice it has been found, however, that a large part of the water evaporates in a natural way or is carried off by the wind without ever reaching the lawn in question. In addition to that, very large quantities of water are used for "inundating" an artificial lawn, which is found to be objectionable in practice both for environmental and for economic reasons.

SUMMARY

The object of the present invention is thus to provide a substructure for an artificial lawn wherein the above problems, in particular as regards the "inundation" of the lawn, are minimised or eliminated.

Another object of the present invention is to provide a substructure for an artificial lawn wherein the water level of the artificial lawn can be controlled to a desired value.

Yet another object of the present invention is to provide a substructure for an artificial lawn wherein a substantially flat, stable base is obtained.

Yet another object of the present invention is to provide a substructure for an artificial lawn wherein the forming of water puddles that remain present on the artificial lawn for a long time in the case of heavy rainfall is prevented or minimised.

DETAILED DESCRIPTION

Figure 1:
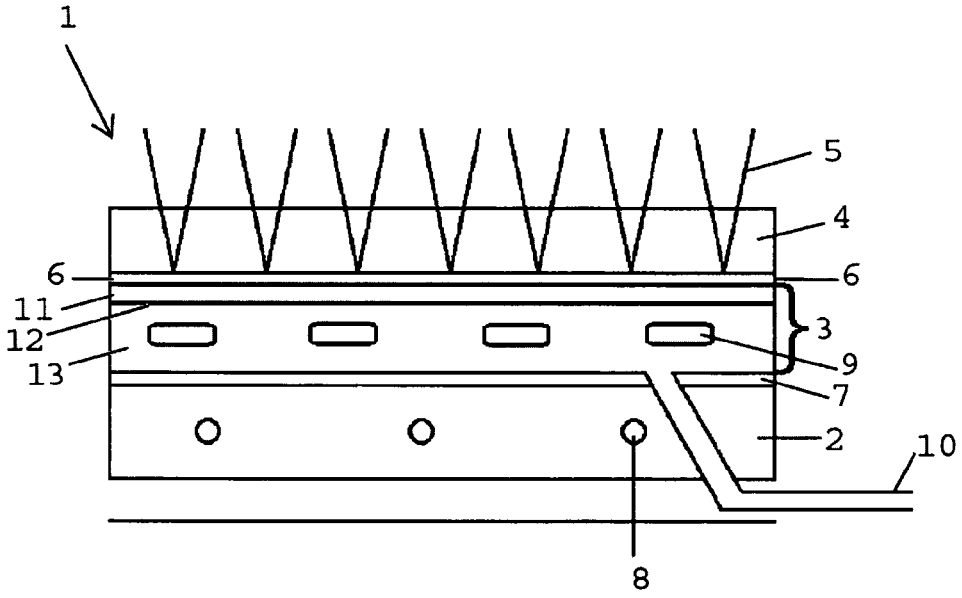
FIG. 1 is a schematic representation of a substructure.

According to the present invention, the substructure as described in the introduction is characterised in that said sand layer comprises at least two sublayers, wherein the first sublayer comprises a sand fraction having a particle size which is larger than the particle size of the sand fraction of the second sublayer.

The aforesaid combination of a base layer, an intermediate layer, a sand layer, and in particular the presence in the sand layer of at least two sublayers with mutually different particle sizes of the solids present therein, and, positioned on top thereof, a top layer of artificial grass fibres has made it possible to achieve one or more of the above objects.

The present inventors have in particular found that it is desirable for the sand layer in the present substructure to meet a number of specific requirements, in which regard it is in particular preferable if the sand layer comprises a sublayer of sand particles wherein at least 80% the particles have a particle size of more than 80 μm, preferably more than 100 μm, in particular more than 125 μm. In a special embodiment it is desirable that the particle size of at least 50% of the sand particles is greater than 125 μm, preferably more than 150 μm, in particular more than 200 μm. The sand layer referred to as the second sublayer comprises sand particles of which at least 80%, preferably at least 90%, have a particle size of at most 2 mm. The second sublayer is therefore a sublayer comprising a sand fraction which is qualified as finer than the first sublayer, viz. the coarser fraction. In particular the coarse fraction, especially the layer referred to as the first sublayer in the sand layer, is also regarded as a layer of pebbles, small stones and gravel. It is in particular the particle size of the sand-like or stone-like material that is of relevance to the present invention. The coarse fraction can also be qualified as a layer of inert materials, in particular comprising sand, gravel, pebbles and small stones. In addition to sand having the desired particle size, the fine fraction may also comprise the usual impurities, such as small stones, gravel and pebbles, which impurities come along with the "screening operation". The latter aspect also applies to the coarse fraction, of course.

It is desirable for the sublayer comprising the coarser sand fraction to be positioned near the top layer. The rain water that will be drained in downward direction through the top layer of artificial grass fibres will thus first pass the coarse sand fraction in the sand layer and subsequently the less coarse sand fraction. An adequate passage of rain water is ensured. Moreover, the opposite direction of movement of water in the substructure, viz. from bottom to top, has been found to be advantageous in the case of such a distribution of fractions in the sand layer. The present substructure in fact shows a simulation of "ebb and flood", which means that the water level in the substructure can fall and rise, with the desired water level being adjustable. Such a transport of liquid through the substructure therefore has an upward direction of movement, viz. in the direction of the top layer, and a downward direction of movement, viz. away from the top layer, whilst the level or the position of the liquid in the substructure has been found to be precisely adjustable.

The particle size values mentioned in the present application also ensure a rapid transport of water through the sand layer, which is desirable if an adjustment of the water level is aimed at. If a sand fraction comprising finer particles than the discussed above is used, the water transport will experience greater resistance, which will adversely affect the speed of response or the response time of the water management system.

By using the aforesaid substructure construction, a substructure has been obtained which provides a stable base for constructing an artificial lawn, in which the formation of hollows and bumps is minimised.

It is preferable if the coarse fraction sublayer comprises particles of which at least 80% have a particle size that ranges from 0-32 mm, preferably 1-32 mm, in particular 1-8 mm, especially 1-4 mm. Such a coarse fraction can also be described as gravel, pebbles. In a particular embodiment, it is desirable to set the lower limit of the coarse fraction at a value of 1 mm, in order to thus exclude fine particles, which particles may have a disadvantageous effect on the water transport through the sand layer.

In a particular embodiment of the present substructure, it is preferable if the thickness of the coarse fraction sublayer is 50-200 mm, in particular 75-125 mm.

Although mention has been made in the foregoing of a first and a second sublayer, it is advisable in certain embodiments for the sand layer to comprise a number of sublayers, for example, three, four or more sublayers. The present invention is not limited to merely two sublayers, however. The aforesaid sublayers may have different particle sizes, but corresponding particle sizes are also possible, in which case such sublayers may be separated from each other, for example by a sublayer having a particle size different from that of adjacent sublayers, or by a separation layer, as will be explained hereinafter.

In order to maintain a prolonged separation of the sublayers present in the sand layer, it is desirable in certain embodiments for the at least two sublayers in the aforesaid sand layer to be separated by a separation layer. A suitable separation layer is selected from the group of cloth, membrane, sheet and geotextile. If more than two sublayers are provided, it is possible to provide separation layers between the various sublayers positioned adjacent to each other. The separation layer is water-permeable, preferably provided with perforations through which water transport can take place but movement of solids from one sublayer to the other sublayer is prevented.

The use of a thus specified sand layer makes it possible to sprinkle the artificial glass fibres "from below", as it were. After all, the supply of water to the top layer of artificial grass fibres takes place via the sand layer positioned under the top layer, wherein in particular the intermediate layer is configured so that the water present in the sand layer cannot drain off to the layers positioned under the sand layer. In addition to that, the aforesaid values for the grain analysis of the sand layer (carried out via a screen arrangement in which different screens having different mesh sizes are stacked one on top of the other and the layer remaining behind on the respective screen is measured, with the results being plotted in a graph) provide a good possibility for the transport of water, viz. as regards flow rate and retention capacity. Coarser sand types are preferred within that framework. In addition to that it has been found that, using such a sand package, very flat layers can be obtained, which is desirable for practising (ball) sports. In addition, there will be no subsidence or rutting when the construction is subjected to heavy loads at the upper side, for example by vehicles being moved thereon. The total layer thickness of the sand package, viz. the layer indicated as the sand layer, is preferably 20-60 cm, in particular 20-50 cm, particularly 30-40 cm.

With a view to thus supplying water at the "bottom side" of the top layer, it is therefore desirable that a system of pipes be present in the sand layer, through which system of pipes water can exit to the sand layer. The system of pipes is preferably positioned in the finer fraction sublayer, viz. the second sublayer, so that a quick response time of the water management system is ensured. Such a position is also desirable in view of the risk of freezing, which makes it desirable for the system of pipes to be installed at a certain depth in the substructure, which situation may occur in particular during cold winter periods in certain countries. In another embodiment it is on the other hand also possible to position the system of pipes in the coarser fraction sublayer, viz. the first sublayer.

The system of pipes thus comprises pipes in which regularly spaced perforations are present, wherein the water to be supplied to the artificial lawn can exit the system of pipes via said perforations and will more or less accumulate in the sand layer. It has been found that the grain size of the sand particles that is preferably used makes it possible to adjust the water level in the sand layer such that an artificial lawn is obtained which exhibits a water level that makes it possible to play thereon, in particular to play field hockey thereon.

In order to prevent the water being supplied to the sand layer via the system of pipes from draining off to the layers positioned under the sand layer, it is preferable if the sand layer is screened off at the bottom side thereof by a water-impermeable layer, preferably a foil, for example a polyethylene foil.

In a special embodiment, it is desirable for a so-called shock-absorbing layer to be present between the top layer of artificial grass fibres and the sand layer, said shock-absorbing layer comprising one or more components selected from the group of SBR rubber, crushed plastic particles, polyethylene, polypropylene, polyamide, polyester or a mixture thereof, possibly in combination with one or more binders. In such an embodiment the top layer of artificial grass fibres is separated from the sand layer by the aforesaid shock-absorbing layer, the presence of which shock-absorbing layer is in particular desirable with a view to positively influencing the ball bounce.

In addition, it desirable that the overall construction of the present substructure meet shock absorption and energy restitution requirements, because excessive springing of an artificial lawn is in particular found to be unpleasant and tiring by the players. If the overall construction of the artificial lawn exhibits too much spring, a ball landing on the artificial lawn will bounce back too high and too quickly in comparison with a natural lawn, which is undesirable. Moreover, the players experience running and making sprints thereon as tiring, and also as unnatural. According to the present inventors, the special use of a shock-absorbing layer has made it possible to construct a lawn in which the aforesaid problems are minimised.

The system of pipes used in the sand layer preferably comprises pressure reducing means for generating an underpressure in the aforesaid system of pipes, wherein the system of pipes further comprises a water reservoir having one or more connection openings, a controllable overflow for adjusting the water level in the reservoir, water level measuring means and a controllable water inlet. In such a construction it is in particular desirable for the pressure reducing means to comprise water level reducing means for reducing the water level in the reservoir, which water level reducing means preferably comprise a plunger pump. The aforesaid system of pipes is furthermore preferably provided with control means which are at least connected to the aforesaid water level measuring means, the controllable water inlet and the pressure reducing means. The aforesaid construction is thus suitable for supplying water to the substructure; it has in particular been found to be possible to treat a large surface area therewith.

The present invention will now be explained by means of a schematic example, in which connection it should be noted, however, that the schematic representation in the appended figures must not be construed as being limitative. Moreover, the figures are not drawn to scale.

FIG. 1 is a schematic representation of a substructure.

Figure 2:
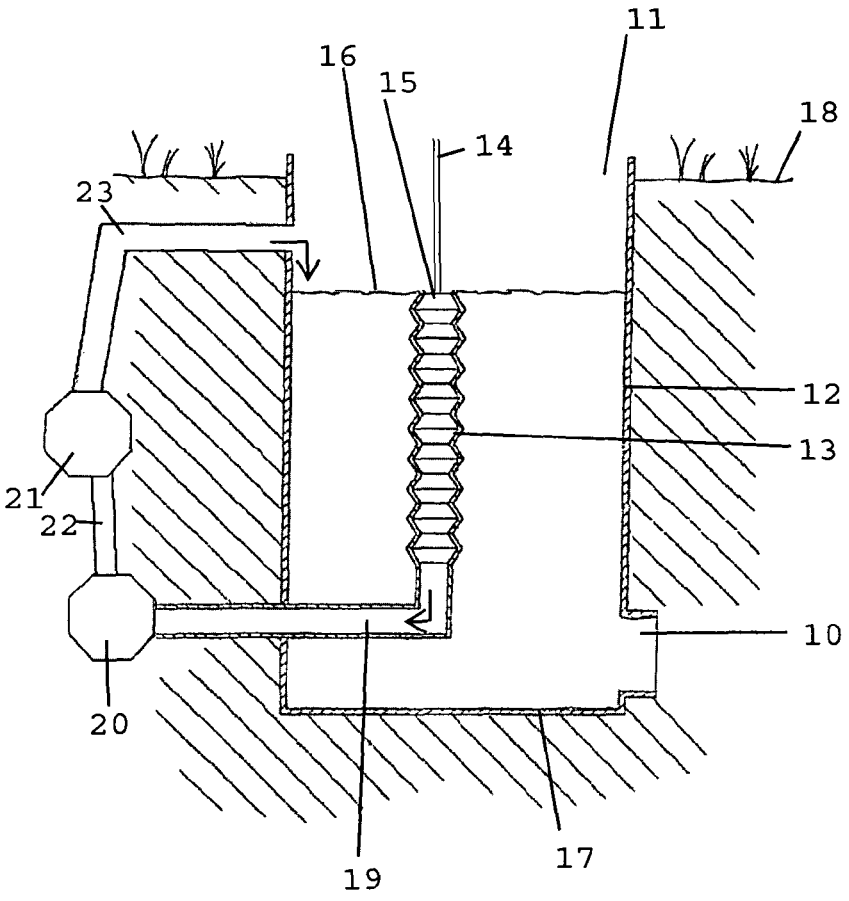
FIG. 2 is a schematic representation for level control.

FIG. 2 is a schematic representation for level control.

FIG. 1 schematically shows a substructure 1 comprising a substratum 2, in which drainage means 8 are optionally present, an intermediate layer 7, in particular a foil, a sand layer 3 comprising a first sublayer 11 and a second sublayer 13, wherein the particle size of the sublayer 11 is coarser than that of the sublayer 13, and being provided with a pipe system 9, a shock-absorbing layer 6 and a top layer 4 present on top thereof with artificial grass fibres 5 present therein, which top layer 4 may be an artificial lawn known from the prior art, wherein blades 5 of a synthetic material are provided in a backing layer. The aforesaid artificial grass blades have been provided in the backing layer by tufting or knitting, for example, followed by the fixation of said fibres using a coating, for example a latex coating. The sublayer 11 and the sublayer 13 are separated by a separation layer 12, for example a geotextile fabric. It should be noted that both figures must be regarded as being schematic and that no dimensions can be derived therefrom.

The substratum 2 may be made up of locally present or existing soil or a layer of sand, asphalt, broken stones or lava granules. The damping layer that is used may be a layer as referred to in NL 1021171, preferably in a thickness ranging between 4 mm and 45 mm. The pipe system 9 comprises means for the drainage of rain water, for example, or means for temperature regulation. Temperature regulation is desirable in particular during cold periods so as to thus obtain a lawn that can be played on by sportspeople without the risk of unwanted injuries, in particular caused by a slippery surface. Temperature regulation may take place by using solar energy, for example.

The special selection of the sand grains in the sand layer 3, in particular the use of a coarse fraction and a fine fraction, wherein the coarse fraction 11 is positioned "on top of" the fine fraction 13, has made it possible to adjust the water level in the sand layer 3, wherein water is in particular supplied via the pipe system 9, which pipe system 9 comprises perforated pipes. The pipe system 9 is in liquid communication with the pipe 10. The pipe system 9 is in fact positioned under the entire artificial lawn, so as to realise adequate water management in the present substructure 1. The supply of water to the top layer 4 is such that an optimum use of the supplied water takes place. The intermediate layer 7 functions to ensure that the water present in the sand layer 3 cannot undesirably exit to the substratum 2 positioned thereunder. Although it is indicated that the top layer 4 comprises artificial grass fibres 5, it is also possible in a specific embodiment for the top layer 4 to comprise natural grass fibres (not shown) and so-called infill materials (not shown), in addition to artificial grass fibres 5. The pipe system 9 is schematically shown in the figure, whilst furthermore a reservoir (not shown) filled with water may be provided, which reservoir comprises one or more drainage pipe connections (not shown), whilst said reservoir is also provided with a float and a controllable overflow for thus adjusting the water level in the sand layer 3. Present at the bottom side of the sand layer 3 or, in a special embodiment, at the substratum 2, whether or not in combination with the sand layer 3, is a pipe 10 which is connected to a drainage device 11, in particular it is in liquid communication with the pipe system 9.

In FIG. 2, the drainage device 11 is further schematically indicated, with the pipe 10 being in the liquid communication with the substructure shown in FIG. 1. Although only one pipe 10 is shown, it should be understood that several pipes 10 may be provided, which are each in communication with the substructure shown in the figure. Usual pumps, pipes and valves have been left out but will be known to the skilled person. Because of the aforesaid liquid communication between the drainage device 11 and the substructure 1, the height of the liquid level 16 in the drainage device 11 is an indication of the liquid level in the substructure. The drainage device 11 is provided with a tube 13, with the height of the water level in the drainage device 11 being determined by the height position of the tube 13, which height position is adjustable. The tube 13 is in communication with the overflow 20 via a pipe 21. The overflow 20 is in communication with the buffer vessel 21 via a pipe 22. The buffer vessel 21 is in communication with the drainage device 11 via a pipe 23.

If the water level in the substructure should fall to an undesirably low level, for example in the case of evaporation caused by the suns' radiation and the wind, it will be desirable that the intended water level be restored, viz. that water be supplied to the substructure. If the water level in the substructure should rise to an undesirably high level due to heavy rainfall, however, it will be desirable that the intended water level in the substructure be restored. In the latter situation, the water level 16 in the drainage device 11 will rise on account of the liquid communication between the substructure and the drainage device 11, and the "excess" water will be discharged from the drainage device 11 via the interior of the tube 13. After all, the tube 13 has a pre-set position and will overflow. The water to be drained will be carried to a so-called overflow 20 via a pipe 19. In the overflow 20, the water drained from the substructure will be collected and subsequently carried to a buffer vessel 21. The buffer vessel 21 is in particular intended as a water reservoir for setting and maintaining the desired water level in the substructure, and consequently also in the drainage device 11. Via a measuring and control system (not shown), the supply of water from the buffer vessel 21, via the pipe 23, to the drainage device 11 will be started when this is desirable, for example, when the height position of the tube 13 is adjusted, in particular by positioning the tube 13 "higher" in the drainage device 11, or when the liquid level 16 is "below" the overflow edge of the tube 13. The supply of water from the buffer vessel 21 via the pipe 23 to the drainage device 11 will continue until the level of the overflow edge of the tube 13 is reached. Once the overflow edge is reached, the supply of water from the buffer vessel 21 via the pipe 23 to the drainage device 11 will be ended. Said supply of water will lead to the supplied water being carried to the substructure via the pipe 10, in which substructure the liquid level will assume the desired value.

It should be noted that the parts shown in FIGS. 1 and 2 are not drawn to scale. For a better understanding of the drainage device 11 the following measures of capacity can be mentioned: capacity of the drainage device 11: 1 $m^3$, capacity of the overflow 20: 0.5 $m^3$, and capacity of the buffer vessel 21: 5 $m^3$. Said values are purely indicative and merely function by way of illustration of the invention.

To achieve optimum energy consumption it is desirable that the equipment used with the drainage device 11 be driven by solar energy. It is also possible to use heating elements in the drainage device 11, or in the buffer vessel 21 and/or the overflow 20, which heating elements are preferably driven by solar energy.

The invention claimed is:

1. A substructure for an artificial lawn, comprising a top layer of artificial grass fibres and a substratum positioned under said top layer, which substratum comprises a number of individual layers, including a base layer, an intermediate layer positioned on top of said base layer and a sand layer positioned on top of said intermediate layer, characterised in that said sand layer consists of at least two sublayers consisting of sand, wherein the first sublayer is a sand fraction having a particle size which is larger than the particle size of the sand fraction of the second sublayer, characterised in that the sublayer having the sand fraction having a particle size which is larger than the particle size of the sand fraction of the second sublayer is positioned near the top layer, characterised in that a system of pipes is present in the sand layer, through which system of pipes water can be passed, wherein water can exit to the sand layer, characterised in that the pipe system in the sand layer is positioned in the sublayer that exhibits a particle size smaller than that of said one or more other sublayers.

2. A substructure according to claim 1, characterised in that the at least two sublayers in said sand layer are separated from each other by means of a separation layer.

3. A substructure according to claim 2, characterised in that said separation layer is selected from the group of cloth, membrane, sheet and geotextile.

4. A substructure according to claim 1, characterised in that the sand fraction having a particle size which is larger than the particle size of the sand fraction of the second sublayer comprises particles of which at least 80% have a particle size that ranges from 1-32 mm.

5. A substructure according to claim 1, characterised in that the thickness of the sand fraction having a particle size which is larger than the particle size of the sand fraction of the second sublayer is 50-200 mm.

6. A substructure according to claim 1, characterised in that a shock-absorbing layer is present between the sand layer and the top layer, said shock-absorbing layer comprising one or more components selected from the group of SBR rubber, crushed plastic particles, polyethylene, polypropylene, polyamide, polyester or a mixture thereof, possibly in combination with one or more binders.

7. A substructure according to claim 1, characterised in that the second sublayer in the sand layer has sand particles of which at least 80% have a particle size of more than 80 μm.

8. A substructure according to claim 1, characterised in that the second sublayer in the sand layer has sand particles of which at least 50% have a particle size of more than 125 μm.

9. A substructure according to claim 1, characterised in that the total thickness of the sand layer is 20-60 cm.

10. A substructure according to claim 1, characterised in that the intermediate layer is a water-impermeable layer.

11. A substructure according to claim 10, characterised in that the water-impermeable layer is a foil.

12. A substructure according to claim 1, characterised in that the system of pipes are configured to generate to reduce pressure for purposes of generating an underpressure in the system of pipes, wherein the system of pipes further comprises a water reservoir having one or more connection openings, a controllable overflow for adjusting the water level in said reservoir, water level measuring means and a controllable water inlet, including necessary pipes, pumps and valves.

13. A substructure according to claim 12, characterised in that the system of pipes are configured to reduce water level for reducing the water level in the reservoir.

14. A substructure according to claim 13, wherein the system of pipes comprise a plunger pump for reducing water level.

15. A substructure according to claim 12, characterised in that the water reservoir is incorporated in a circuit which further comprises a buffer vessel and an overflow.

16. A substructure according to claim 12, characterised in that the water reservoir is connected with the substructure via one or more connection openings, which connection openings are located adjacent to the water-impermeable layer.

17. A substructure according to claim 12, characterised in that solar energy is used for driving the pumps, valves and control means.

* * * * *